US007507170B1

(12) United States Patent
Steen

(10) Patent No.: US 7,507,170 B1
(45) Date of Patent: Mar. 24, 2009

(54) 21ST CENTURY CHALLENGE AMERICA BASKETBALL GAME

(76) Inventor: John Burton Steen, 824 Crossfire Ct., Marietta, GA (US) 30064

( * ) Notice: Subject to any disclaimer, the term of this patent is extended or adjusted under 35 U.S.C. 154(b) by 0 days.

(21) Appl. No.: 11/786,901

(22) Filed: Apr. 13, 2007

(51) Int. Cl.
*A63B 67/00* (2006.01)

(52) U.S. Cl. ..... 473/472

(58) Field of Classification Search ..... 473/472, 473/569, 447, 486, 470, 471, 465, 415; 40/327; 273/400

See application file for complete search history.

(56) References Cited

U.S. PATENT DOCUMENTS 4,171,808 A * 10/1979 Bauer ..... 473/472
5,388,821 A * 2/1995 Blackburn ..... 473/484
5,549,293 A * 8/1996 Seifert ..... 273/317.3
5,601,284 A * 2/1997 Blackwell et al. ..... 473/483
5,893,809 A * 4/1999 Coats et al. ..... 473/479
6,390,940 B1 * 5/2002 Naulls et al. ..... 473/472
7,270,617 B2 * 9/2007 Henning ..... 473/504
2006/0068945 A1 * 3/2006 Murchison ..... 473/415

OTHER PUBLICATIONS

Webpage download, BetterBasketball, 2004, www.betterbasketball.com, 3 pages.*

* cited by examiner

*Primary Examiner*—Gene Kim
*Assistant Examiner*—M Chambers
(74) *Attorney, Agent, or Firm*—H. Brock Kolls

(57) ABSTRACT

In the 21st Century Challenge America Basketball Game, the three-point line is placed at eighteen feet and enhanced with a 56.25 degree elliptical arc meaning the three-point shot can increase in length from eighteen to twenty four feet as the player moves to the top of the key. A four-point shot has been introduced. The basket use has been raised to between ten feet one inch to fifteen feet eleven inches depending on agreed level and selection of play and division level of play. Shots made "in the paint" are worth one point. The game is played on a one hundred foot court.

3 Claims, 1 Drawing Sheet

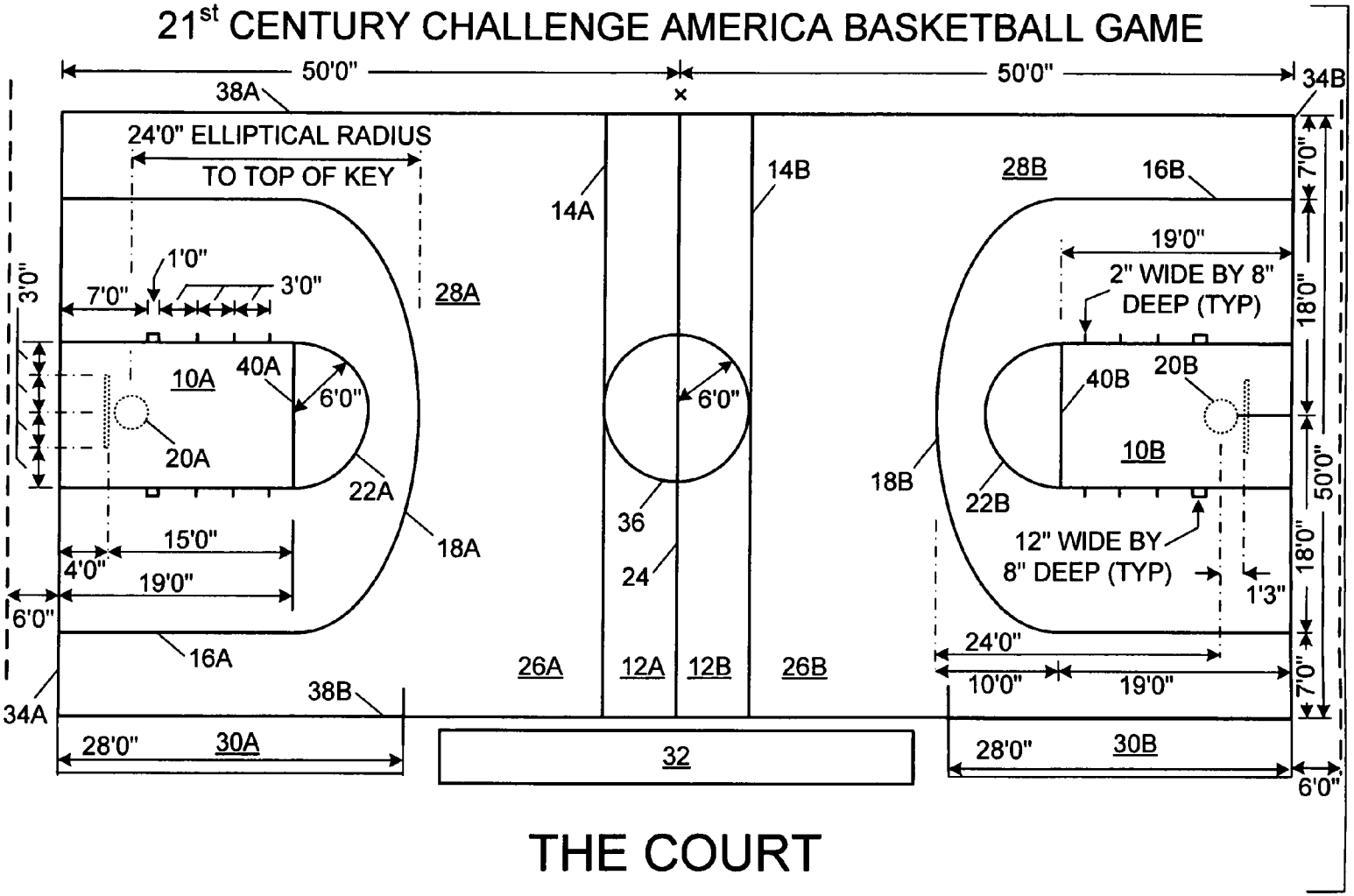
21st CENTURY CHALLENGE AMERICA BASKETBALL GAME
THE COURT
50'0"
50'0"
x
34B
34A
7'0"
18'0"
50'0"
18'0"
7'0"
6'0"
1'3"
16B
19'0"
2" WIDE BY 8" DEEP (TYP)
20B
10B
40B
12" WIDE BY 8" DEEP (TYP)
19'0"
30B
28B
22B
24'0"
10'0"
28'0"
18B
14B
26B
6'0"
12B
12A
36
24
32
14A
26A
28A
18A
24'0" ELLIPTICAL RADIUS
TO TOP OF KEY
22A
6'0"
38B
38A
3'0"
40A
1'0"
10A
20A
15'0"
19'0"
16A
30A
7'0"
4'0"
28'0"
3'0"
6'0"

21ST CENTURY CHALLENGE AMERICA BASKETBALL GAME

TECHNICAL FIELD OF THE INVENTION

The present invention relates to a basketball game and in particular to making the game more challenging and rewarding for the players and to improve specifically their ball-handling and shooting skills. Thus, several aspects of the old game have been changed to address these issues.

BACKGROUND OF THE INVENTION

This invention addresses the sports game invented by Dr. James A. Naismith in 1891 at Springfield College, Springfield Mass. His selection of the thirteen rules of the game was to facilitate the function of an exercise activity. No consideration was given to playing, court size, basket (goal) height, male versus female adaptability, future human species physical demographics, male versus female genetics, potential youth-age adaptability, academic scholarships, professional adaptation, added value, player performance, maintenance of essential facilities and rules to maintain the necessary value of the game and to support the intrinsic and historical value to all.

With the obvious concern of those in charge, even the one apparent progressive rule addition in 1987 of the three-point radial shot from 18 feet has, after approximately 25 years, thus far been diluted by the continued NCAA administration of 50-75 years of the questionably used "mini-rules" management changes. The length of the three-point shot is now experimentally up to twenty feet nine inches for men and nineteen feet nine inches for women players. Dr. Ed Steitz was the athletic director at Springfield College and spent about five years on the rules committee to get this rule approved. My sense of court balance is that eighteen feet was the right distance in order to help reduce the player basket density. The 1977 rule change to allow dunking was implemented after the nine year NCAA ban. This rule was a result of Texas Western dunking themselves to a national championship over Kentucky in 1966.

Levels of play have relinquished the need for both player performance and balanced player improvement. Player growth and performance now centered on player height, not shooting and ball-handling development. "Dunking the ball"—so-called points in the paint—has become the standard.

SUMMARY OF THE INVENTION

The result of the totally new game is a greater challenge for the players, enhanced ball-handling and shooting skills required to play the game and greater excitement for the spectators. The specific aspects that have been created are the following:

The three-point line 16A and 16B is placed on the side at eighteen foot and is used in conjunction with a 56.25 degree elliptical twenty-four foot arc 18A and 18B at the top of the key 22A and 22B. This eliminates NCAA constant use of "mini" rule changes. The shot distance gets longer as the player moves back down the court from eighteen feet to twenty-four feet;

The length of the court is extended from ninety four feet to one hundred feet for improved transition play;

The basket 20A and 20B height is increased to be used from ten feet one inch to fourteen feet depending upon the desired level of play for pre-college and college level. Pro-level of play will be between fifteen feet and fifteen feet eleven inches, the latter for special entertainment;

The award for points "in the paint" is reduced from two to one point per basket made "inside the paint" during play; and A four-point shot line has been incorporated into the court layout, increasing the use length twelve feet for offensive ball play. The "hail-mary" type shot has not been affected but added to its special effect.

BRIEF DESCRIPTION OF THE FIGURES

The FIGURE illustrates one example of a 21st Century Challenge America Basketball Game court. All lines shall be two inches wide (neutral zones excluded). The color of the lane space marks and neutral zones marks shall contrast with the color of the lane boundary marks.

REFERENCE NUMERALS IN THE DRAWING

10A and 10B in paint region also referred to as free throw lane 10A and 10B
12A and 12B four-point region
14A and 14B four-point line line
16A and 16B three-point line
18A and 18B twenty-four foot arc portion of the three point line
20A and 20B goal also referred to as basket 20A and 20B
22A and 22B top of key line
24 division line also referred to as center of the court line 24
26A and 26B transition zone region
28A and 28B three-point region
30A and 30B coaching boxes
32 scorers table
34A and 34B end line
36 center circle
38A and 38B side line
40A and 40B free throw line

DETAILED DESCRIPTION OF THE INVENTION

Turning to the present invention, an advantage of selectivity of basket height and mutual agreement of height to be used can strengthen the 21st Century Challenge America Game play as outlined in Table 1 below:

TABLE 1

| Class | Team Classification | Minimum Basket Height | Minimum Court Size Length |
|---|---|---|---|
| 1 | General Playgrounds | Ten feet one inch | Seventy feet by forty feet |
| 2 | Elementary Schools | Ten feet one inch | Seventy feet by forty feet |
| 3 | Jr. High Schools and the like | Ten feet one inch | Seventy feet by forty five feet |
| 4 | High Schools and the like | Ten feet one inch | Ninety feet by fifty feet |
| 5 | Jr. College and the like | Eleven feet | One hundred feet by fifty feet |
| 6 | College Division NAIA | Eleven feet | One hundred feet by fifty feet |
| 7 | College Division III | Twelve feet | One hundred feet by fifty feet |
| 8 | College Division II | Thirteen feet | One hundred feet by fifty feet |
| 9 | College Division I | Fourteen feet | One hundred feet by fifty feet |

TABLE 1-continued

| Class | Team Classification | Minimum Basket Height | Minimum Court Size Length |
|---|---|---|---|
| 10 | Professional and the like | Fifteen feet | One hundred feet by fifty feet |
| 11 | Professional assisted and the like | Fifteen feet eleven inch | One hundred feet by fifty feet |

Any classification can be selectively paired to compete at any basket height in classes six thru nine. Classes ten and eleven can be paired. Class eleven can use player entertainment assists in making a basket.

21$^{st}$ Century Challenge America Basketball Game Play uses three new rules including: one point scored in the paint 10A and 10B; eighteen to twenty-four feet at base line to top of key 22A and 22B three-point shot; and basket height for Class six thru nine to be mutually agreed upon at scheduling prior to season.

This new invention addresses the out-of-date standards and makes the game of basketball more challenging. Moreover, it simultaneously enhances player performance, scoring, and in ball handling skills. In this regard:

The three-point shot line 16A and 16B is again placed at Dr. Ed Steitz's eighteen foot distance. It is now coupled to an elliptically shaped 56.25 degree arc 18A and 18B enhancement located nineteen feet from the end of the court to the center of the basket 20A and 20B. The shot gets longer (up to twenty-four feet) as the ball handler moves toward the center of the court 24 to the top of the key 22A and 22B;

The length of the basketball court is extended from the current ninety four feet to one hundred feet to improve transitional play and accommodate the new three-point elliptically-designed shot as described above;

To prevent the dunk from further destroying the game, scoring values have been reassigned so that only one point is awarded for dunks and other shots made "in the paint" 10A and 10B; whereas up to four-points can be earned for successful attempts originating "outside the paint". A four-point zone 12A and 12B of twelve feet; six feet on either side of the center of the court 24 will be shown on the court drawing. The back court violation will occur against the offensive team if they go back over the beginning line of the four-point line line 14A and 14B as illustrated in the FIGURE; and To accommodate various players skill levels from elementary, junior high and high school, the basket will be placed at a height of ten feet one inch. College height will range from eleven feet to fourteen feet for the four divisions as illustrated in Table 1. The professional game is played with a basket height at fifteen feet. A height of fifteen feet eleven inches will be allowed for special occasions or entertainment reason/needs. Professional teams will be encouraged to sign up to play 21$^{st}$ Century Challenge America Basketball.

With the installation of the higher baskets, players will be required to improve their shooting, ball handling and floor play-making maneuvers rather than let the points "in the paint" continue to dominate the once unique strategy of the game.

The 21$^{st}$ Century Challenge America Basketball Game has been invented to make the game more challenging and rewarding for the players and to improve specifically their ball-handling and shooting skills. Thus, several aspects of the old game have been changed to address these issues.

First of all, the three-point shot eighteen foot side line has been reinstated and is combined with an elliptical enhancement so that the shot will be longer from eighteen feet to twenty four feet as the player moves towards the center of the court to the top of the key. The FIGURE shows the full court including this and other designated changes.

Secondly, the court is extended from ninety four feet to one hundred feet to improve transition play and accommodate the use of the new elliptically shaped, three-point shot arc. The introduction of a "four-point line line" further extends the court in that a player on offense may launch the ball in a talented "hail-mary" shot, for example anywhere in front of the four-point line on the opponents end of the court.

The "four-point line line" 14A and 14B fixes the back court rule in each direction of play. The "four-point line line" 14A and 14B increase interest in talented scoring and transition play 26A and 26B in this twelve foot by fifty foot section across the court in setting up for offensive play action.

Also baskets made "in the paint" will be rewarded only one point. This change is designed to encourage the player "outside the paint" to shoot from a distance that will receive two-points instead of one. This will in turn move players from beneath the basket and enable the referees to officiate the game with more accuracy and taking less time to confer to make the correct call, which will alleviate some of the discord of the game delay.

The height of the basket is increased and may now be placed at heights ranging from ten feet one inch to fourteen feet depending upon Class and Division level of play. Raising the basket for all levels of play will result in a more challenging game for the player and a more entertaining game for the spectators. In case of games scheduled between different Divisions 1 and 4 levels of play, a height of eleven feet to fourteen feet can be agreed upon and depending on inter-conference or conference rules for heights can be used. Heights are designed for professional use, for standard, and entertainment levels of play as illustrated in Table 1.

This invention is intended to keep the game of basketball alive, prevent its stagnation and prevent its 115 years of use from causing a stalemate due to things that Dr. James A. Naismith could not have possibly foreseen. A factor such as physical demographics of the player has dramatically changed the way the game was intended to be played. The new ideas of a three-point shot including technical adaptation with elliptical/technical methods only supports the times requiring more advanced use in coupling new ideas with achieving advanced use.

By going back to Dr. Ed Steitz's eighteen foot three-point shot from the side and coupling it with use of a 56.25 degree arc means the player has to shoot twenty four feet at the top of the key versus eighteen feet.

Use of the elliptical arc to gradually increase the distance requires constant adjustment by the shooter as his position is constantly changing as he moves back down the court, requiring creative advanced player achievement.

Transition play is under constant pressure and more space is needed. The extra six feet of court does this, as well as the extra twelve feet of play from the four-point shot process. The back court violation allowed six feet further back to allow more playing room. The "hail-mary" shot is not affected on offense but longer challenging shots and excitement are encouraged.

The dominance of the dunk requires the one point "in the paint" shot so that the player has to shoot a short shot creating more shooting skills around the basket and taking away close in crowded "in the paint" area shooting, creating better decisions for the referees. Dunking will still be one point and the player then has a choice of how to score. This new game will have more room for the shorter player and the scholarships that are available.

The basket use at higher heights will increase the value of player performance for both the tall and shorter players in both men and women. Division standards will accommodate more varieties of players and offer higher goals for participation at many levels. Coaching comprehension will improve as more ways to play as the game advances technically and be more rewarding during play-offs. This invention will give our historic game back, make players have to shoot, ball handle, play make using transition play with more available space. It is not how tall you are it is how you can use the size you are with more aspects to use with the latest technology and facilities provided by this new game.

All other necessary rules and conditions can stay in place and be utilized in rounding out the 21$^{st}$ Century Challenge America Basketball Game.

The result of the totally new game is a greater challenge for the players, enhanced ball-handling and shooting skills required to play the game and greater excitement for the spectators. The specific aspects that have been created are the following:

The three-point line 16A and 16B is placed on the side at eighteen feet and is used in conjunction with a 56.25 degree elliptical twenty-four foot arc 18A and 18B at the top of the key 22A and 22B. This eliminates NCAA constant use of "mini" rule changes. The shot distance gets longer as the player moves back down the court from eighteen to twenty-four feet;

The length of the court is extended from ninety-four feet to one hundred feet for improved transition play;

The basket height is increased to be used from ten feet one inch to fourteen feet depending upon the desired level of play for pre-college and college level. Pro-level of play will be between fifteen feet and fifteen feet eleven inches, the latter for special entertainment;

The award for points "in the paint" is reduced from two to one point per basket made "inside the paint" during play; and A four-point shot line has been incorporated into the court layout as illustrated in the FIGURE, increasing the use length twelve feet for offensive ball play. The "hail-mary" type shot has not been affected but added to its special effect.

What is claimed is:

1. An improved method of playing basketball, said improved method comprising:

providing a rectangular region defining a game play surface, two opposite sides of said rectangular region are an end line, a division line is disposed equal distance between each of said end line, said game play surface dimensions are determined by a team classification; each of an in paint region, a three-point line placed on sides of said in paint region and having a 56.25 degree elliptical arc extending above said in paint region enhancing transition zone play between said three-point line and said division line, said elliptical arc creating approximately nineteen feet to twenty four feet shooting distance between said three-point line and a goal, and a four-point line proximate said division line creating a four-point region are located within and at opposite ends of said game play surface, said in paint region, said three-point line, said four-point line, and said division line are disposed on said game play surface such that said in paint region is located at said end line closest to said goal and furthest from said division line, said three-point line is located around said in paint region, and said four-point line is located between said three-point line and said division line;

providing said goal defined by a hoop located over each said in paint region, said hoop is located at a fixed distance above said in paint region, said fixed distance is determined by preseason agreement between competitors and in accordance with said team classification;

disposing said in paint region on said game play surface forming a region in close proximity to said goal, said in paint region being positioned to promote skilled and short player game play by deterring tall players from effectuating dunk type shot techniques that result when a player shoots said ball through said goal while standing within said in paint region by rewarding lowest amount of points for such dunk type scoring shots; and scoring points during game play as follows: said player standing, within said in paint region, and shooting said ball through said goal receives one point; said player standing, within region between said in paint region and said three-point line, and shooting said ball through said goal receives two points; said player standing, within region between said three-point line and said four-point line, and shooting said ball through said goal receives three-points; and said player standing, within said four-point region, and shooting said ball through said goal receives four-points.

2. The improved method in accordance with claim 1, wherein dimensions of said game play surface are seventy feet by forty feet for general playground and elementary school said team classification; seventy five feet by forty five feet for junior high school said team classification; ninety feet by fifty feet for high school said team classification; and one hundred feet by fifty feet for junior college, college divisions, and professional said team classification.

3. The improved method in accordance with claim 1, wherein said fixed distance is ten feet one inch for general playground, elementary school, junior high school, and high school said team classification; eleven feet for junior college, college division NAIA said team classification; twelve feet for college division III said team classification; thirteen feet for college division II said team classification; fourteen feet for college division I said team classification; fifteen feet for professional said team classification; and fifteen feet eleven inches for professional assisted said team classification.

* * * * *